US005894098A

United States Patent [19]

Hsieh

[11] Patent Number: 5,894,098

[45] Date of Patent: Apr. 13, 1999

[54] TROMBONE

[76] Inventor: Wu-Hong Hsieh, No. 46, Lane 59, Chungcheng Rd., Luchou Hsiang, Taipei Hsien, Taiwan

[21] Appl. No.: 08/967,356

[22] Filed: Nov. 7, 1997

[51] Int. Cl.[6] ..... G10D 7/10

[52] U.S. Cl. ..... 84/387 A; 84/453

[58] Field of Search ..... 84/387 A, 453; 224/910, 265, 267

[56] References Cited

U.S. PATENT DOCUMENTS

| | | | |
|---|---|---|---|
| 3,164,052 | 1/1965 | De Mire | 84/398 |
| 3,937,116 | 2/1976 | Ramirez | 84/395 |
| 5,656,788 | 8/1997 | Wise | 84/395 |

*Primary Examiner*—William M. Shoop, Jr.
*Assistant Examiner*—Kim Lockett
*Attorney, Agent, or Firm*—Merchant, Gould, Smith, Edell, Welter & Schmidt, P.A.

[57] ABSTRACT

A trombone includes a bell flare, a tuning slide connected with the bell flare via a tuning-slide crook, a bell brace securely connected between the tuning slide and the bell flare, a hand slide which has a first end slidably received within the tuning slide and a second end which is detachably connected with a cup, and an outer slide brace securely connected between the hand slide and the tuning slide further has an adjustable support securely mounted onto the bell flare for the user to distribute the weight of the trombone evenly onto the user's upper arm. Furthermore, a grip portion provided between the hand slide and the tuning slide is able to provide the user a comfortable grip effect when holding the trombone. An adjusting device mounted on the tuning slide and a distal end of which is adjustably and detachably engaged with a bell lock mounted at an intersection of the hand slide and the tuning slide is able to provide a suitable length for the extension of the user's arm.

3 Claims, 4 Drawing Sheets

TROMBONE

FIELD OF THE INVENTION

The present invention generally relates to a trombone, and more particularly to a trombone the weight of which is able to be evenly seated on a user's upper arm and it also provides a convenient arcuate portion in the tuning slide so that the user's head can look straight forward when playing the trombone.

BACKGROUND OF THE INVENTION

A conventional trombone shown in FIG. 5 includes a bell flare 50, a bell brace 51 securely mounted between the bell flare 50 and a tuning slide 52, an inner slide brace 53 and an outer slide brace 54 securely mounted between the tuning slide 52 and a hand slide 55 and a "U" shaped tuning-slide crook 56 integrally formed with distal ends of the bell flare 50 and the tuning slide 52, hence connecting the bell flare 50 with the tuning slide 52 into one piece.

The trombone discussed above suffers several disadvantages in that when the user is playing it, the weight of the trombone is solely supported by one of the user's hands, therefore, the user could feel very tired after a period of time holding the trombone. Furthermore, because of the disposition of the tuning slide 52, the user's neck will have to twist so as to blow into a cup 57. Additionally, when the user is playing the trombone, a left thumb engages the bell brace 51 and then the other four fingers of the user's left hand hold the inner slide brace 53 tightly. However, owing to the distance between the bell brace 51 and the inner slide brace 53 being fixed, it is difficult for users having small hands to play the instrument.

From the previous description, it is noted that conventional trombone are not able to be practically ergonomic. Therefore, a comfortable structure for holding a trombone is necessary.

Thus, a trombone constructed in accordance with the present invention tends to mitigate and/or obviate the aforementioned problems.

SUMMARY OF THE INVENTION

The main objective of the invention is to provide a trombone having provided thereon an inverted "Y" shape support which is able to be seated on the user's upper arm, so the weight of the trombone is fully supported when it is being played.

Another objective of the invention is to provide a trombone having provided thereon a grip portion, so that the user is able to move the hand slide with ease.

Another objective of the invention is to provide an adjusting device mounted on the tuning slide to adjust the distance between the grip portion and the tuning-slide crook, so that different users having different sizes of palms are still able to find a suitable position to play the instrument.

Other objects, advantages and novel features of the invention will become more apparent from the following detailed description when taken in conjunction with the accompanying drawings.

BRIEF DESCRIPTION OF THE DRAWINGS

The present invention will now be better understood with reference to the following drawings, wherein.

DETAILED DESCRIPTION OF THE PREFERRED EMBODIMENT

Figure 1:
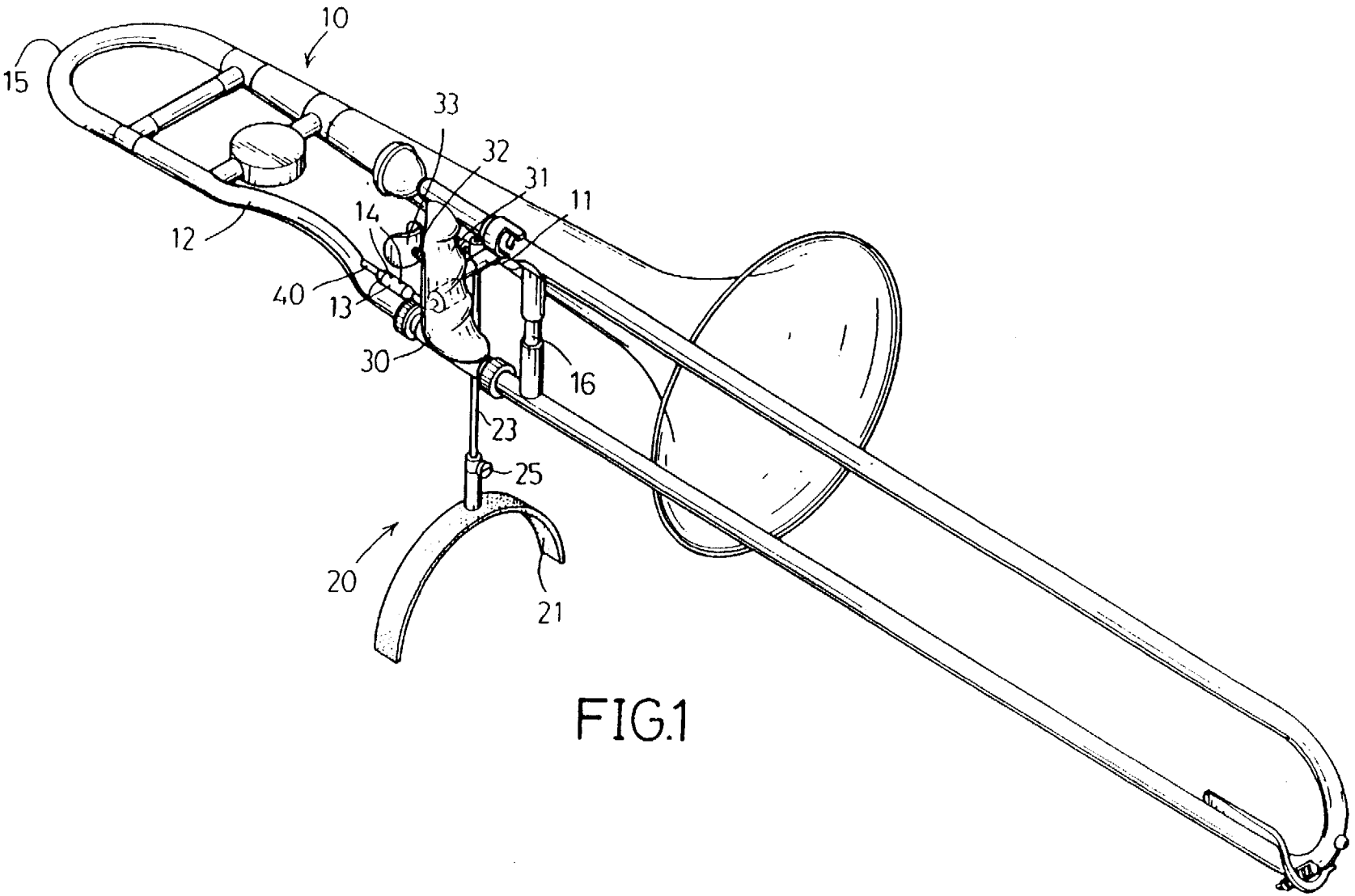
FIG. 1 is a perspective view of a preferred embodiment of a trombone constructed in accordance with the present invention.

Referring to FIG. 1, one preferred embodiment of a trombone constructed in accordance with the invention is shown. The trombone includes a bell flare 10, a tuning slide 12, a bell brace 11 securely connected between the bell flare 10 and the tuning slide 12 and a tuning-slide crook 15 substantially shaped as a "U", which connects an edge of the bell flare 10 and an edge of the tuning slide 12. It is to be noted that a support 20 substantially shaped as an inverted "Y" is mounted under the bell brace 11. The support 20 has an arcuate portion 21 which is to be seated onto a user's upper arm to distribute the weight of the trombone evenly on the user's upper arm, an inner tube 22 (as shown in FIG. 3), an outer tube 23 having the inner tube 22 slidably received therein and a screw hole 24 defined in the outer tube 23 for a screw 25 to be inserted therein to abut an outer periphery of the inner tube 22, such that a length of the support 20 is able to be adjusted according to different users.

Figures 2, 3:
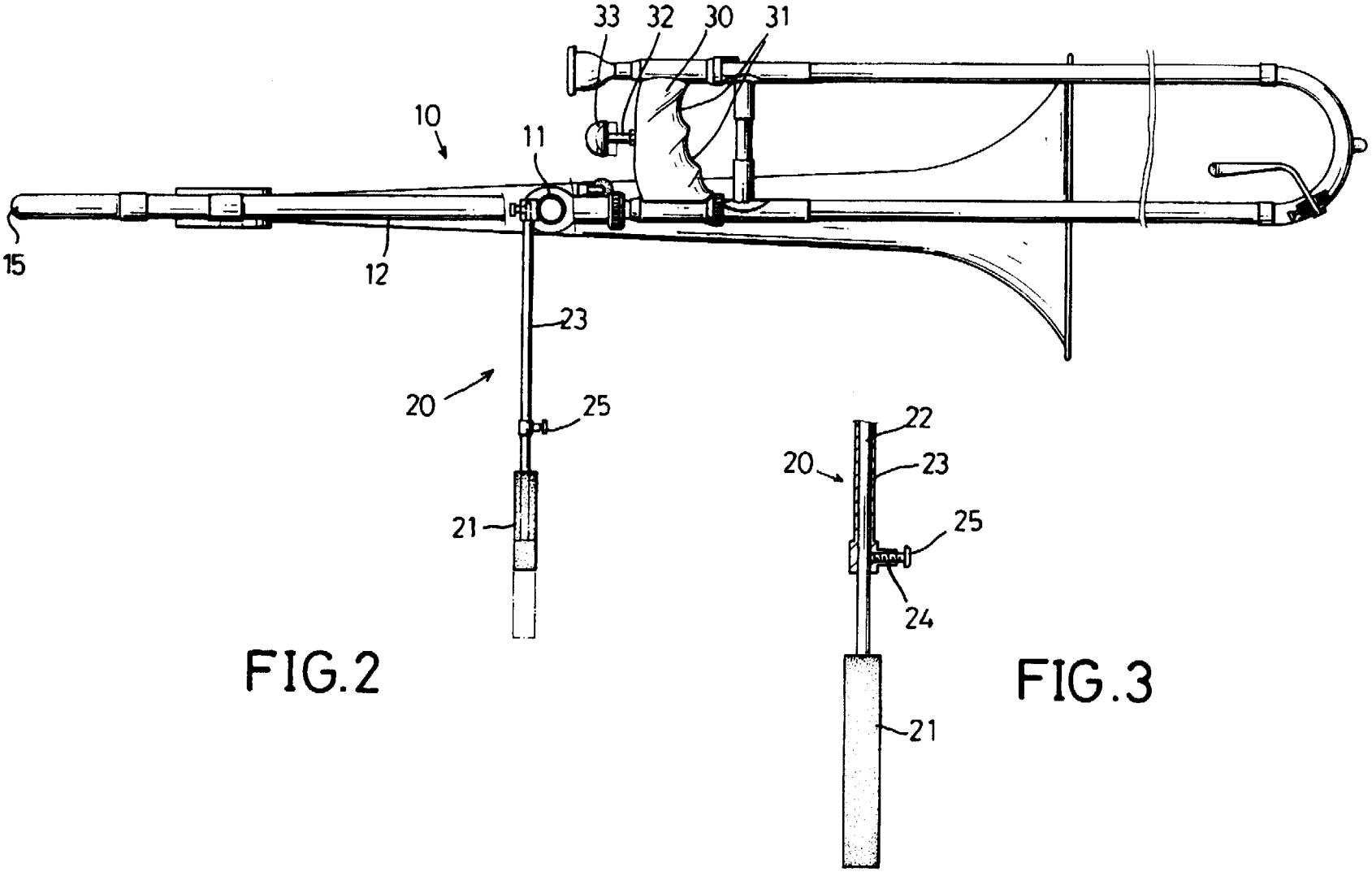
FIG. 2 is a side elevational view of the preferred embodiment of the invention shown in FIG. 1.
FIG. 3 is a partial sectional view of an inverted "Y" shape support of the invention.
Figure 4:
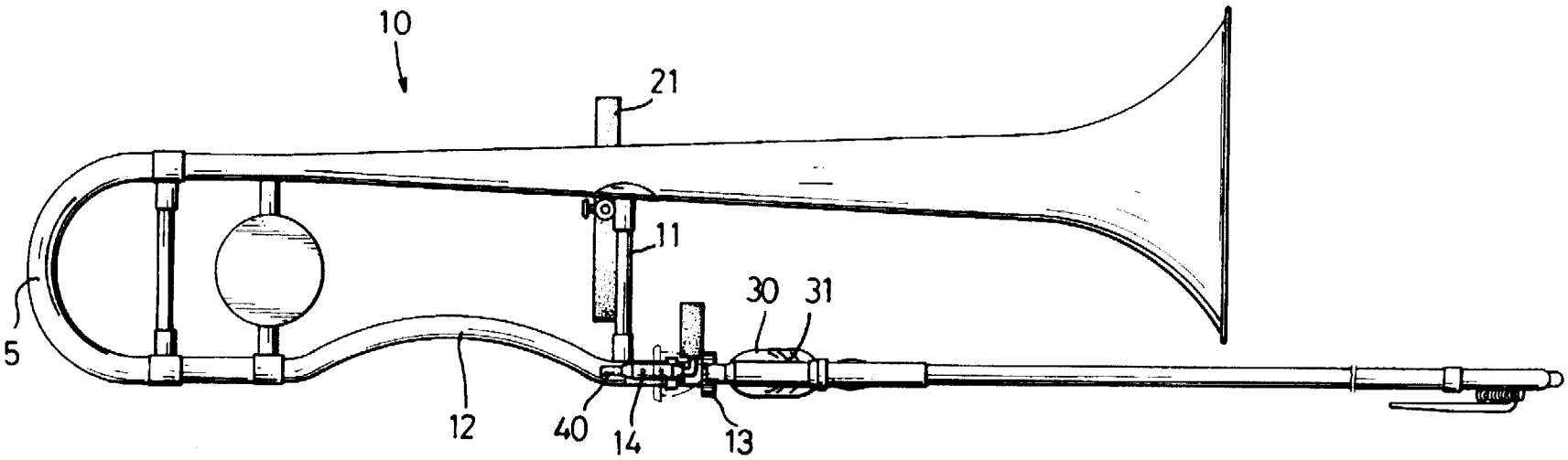
FIG. 4 is a top plan view of the invention.
Figure 5:
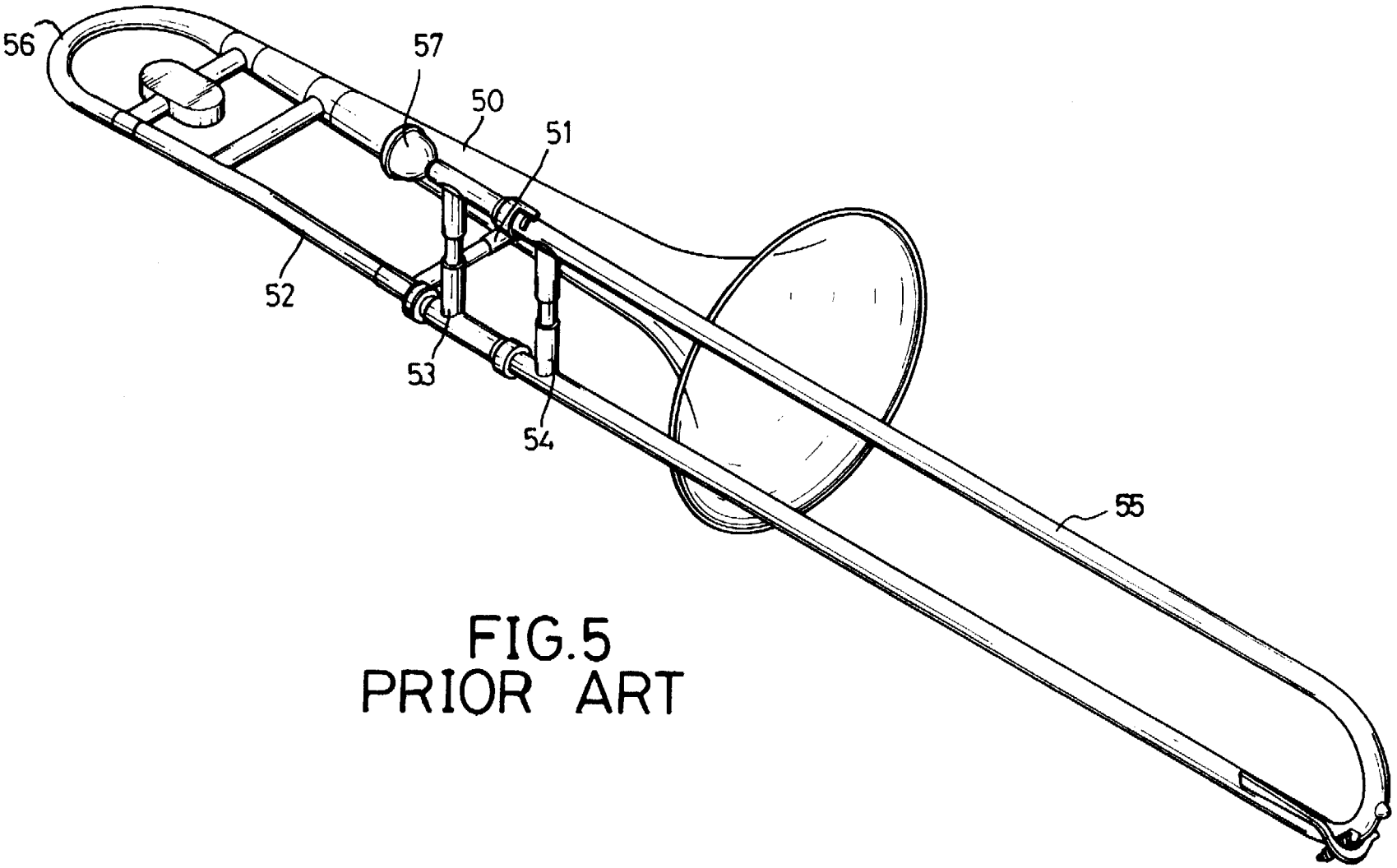
FIG.5 PRIOR ART
FIG. 5 is a perspective view of a conventional trombone.

Referring to FIGS. 1, 2 and 4, a grip portion 30 having an undulating face 31 formed thereon is provided at a position where an inner slide brace (not shown in the Figures) is positioned. A rod 32 having an arcuate plate 33 securely connected to a distal end thereof is provided adjacent to a rear of the grip portion 30 and relative to an outer slide brace 16. Furthermore, a portion of an adjsting device 40 which is substantially "L" shaped is provided at a position close to a bell lock 13 and another portion of the adjusting device 40 detachably engages with a rear face of the bell lock 13, such that when a length of the adjusting device 40 is adjusted, for example, via a relationship between telescopic tubes thereof, the length is locked by a fastening 14, so that the user is able to acquire a suitable length for the extension of his/her arm.

When in use, the thumb of the user's left hand engages the arcuate plate 33, and the other four fingers are then able to hold the grip portion 30 easily and firmly. While the user is doing the aforementioned procedure, the inverted "Y" shaped support 20 will naturally be seated on the user's upper arm to provide the user a comfortable support of the weight of the trombone. Additionally, the tuning slide 12 is formed to have an arc so that the user's head can look straight forward when playing the instrument.

From the foregoing, it is seen that the objects hereinbefore set forth may readily and efficiently be attained, and since certain changes may be made in the above construction and different embodiments of the invention without departing from the scope thereof, it is intended that all matter contained in the above description or shown in the accompanying drawings shall be interpreted as illustrative and not in a limiting sense.

What is claimed is:

1. A trombone having a bell flare, a tuning slide connected with said bell flare via a tuning-slide crook, a bell brace securely connected between said tuning slide and said bell flare, a hand slide having a first end which is slidably received within said tuning slide and a second end which is detachably connected with a cup, and an outer slide brace securely connected between the hand slide and said tuning slide, wherein the improvements are:

an adjustable inverted "Y" shaped support is securely connected to said bell brace.

2. The trombone as claimed in claim 1 further having a grip portion securely provided between said hand slide and said tuning slide and having an undulating face formed thereon for providing a grip effect.

3. The trombone as claimed in claim 1 further having an adjusting device provided onto said tuning slide and a distal end of which is adjustably and detachably engaged with a rear face of a bell lock securely mounted at an intersection of said hand slide and said tuning slide and in the front of said bell brace.

* * * * *